US007710046B2

(12) United States Patent
Park et al.

(10) Patent No.: US 7,710,046 B2
(45) Date of Patent: May 4, 2010

(54) BALANCE COIL AND INVERTER FOR DRIVING BACKLIGHT

(75) Inventors: Cheol-jin Park, Hwanseong-si (KR); Ryuichi Kimura, Suwon-si (KR); Jin-Gyu Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 761 days.

(21) Appl. No.: 11/484,780

(22) Filed: Jul. 12, 2006

(65) Prior Publication Data

US 2007/0035257 A1 Feb. 15, 2007

(30) Foreign Application Priority Data

Aug. 10, 2005 (KR) ..... 10-2005-0073426

(51) Int. Cl.
*H05B 37/00* (2006.01)

(52) U.S. Cl. ..... 315/274; 315/276; 336/173; 336/213

(58) Field of Classification Search ..... 336/170, 336/173, 174, 175, 212, 213; 315/274, 275, 315/276, 280
See application file for complete search history.

(56) References Cited

U.S. PATENT DOCUMENTS

| | | | | |
|---|---|---|---|---|
| 7,176,777 | B2 * | 2/2007 | Hsueh et al. | 336/208 |
| 7,294,973 | B2 * | 11/2007 | Takahama et al. | 315/224 |
| 2004/0212476 | A1 | 10/2004 | Hsueh et al. | |

FOREIGN PATENT DOCUMENTS

| | | |
|---|---|---|
| JP | 09-190779 | 7/1997 |
| JP | 2000-012336 | 1/2000 |
| JP | 2002-075672 | 3/2002 |
| KR | 100133625 | 12/1997 |
| KR | 1020020077564 | 10/2002 |

* cited by examiner

*Primary Examiner*—David Hung Vu
(74) *Attorney, Agent, or Firm*—Roylance, Abrams, Berdo & Goodman, L.L.P.

(57) ABSTRACT

Provided is an inverter for driving a backlight such as LCD, wherein the inverter includes a driving circuit for driving at least two of a plurality of lamps; a transformer for connecting the driving circuit to the plurality of lamps; and a balance coil connected to at least two of the plurality of lamps for balancing the current flowing through the at least two of the plurality of lamps, and the balance coil further includes a bobbin having a winding part divided into at least three parts; a core disposed in the bobbin; and first and second coils disposed on the divided winding parts.

15 Claims, 4 Drawing Sheets

BALANCE COIL AND INVERTER FOR DRIVING BACKLIGHT

CROSS-REFERENCE TO RELATED APPLICATIONS

This application claims benefit under 35 U.S.C. § 119(a) of Korean Patent Application No. 2005-73426, filed Aug. 10, 2005 in the Korean Intellectual Property Office, the entire disclosure of which is hereby incorporated by reference.

BACKGROUND OF THE INVENTION

1. Field of the Invention:

The present invention relates to an inverter used for driving a backlight of a liquid crystal display (LCD). More particularly, the present invention relates to a balance coil and an inverter for driving a plurality of Cold Cathode Fluorescent Lamps (CCFL) in parallel.

2. Description of the Related Art:

Current LCD displays require a backlight unit that is small in size and efficient. Consequently, CCFL is widely used as a light source of backlight unit. However, a single back light unit equipped with only one lamp is not sufficient for use in a wide-bodied display. Instead, multiple backlight units using a plurality of lamps are used because they better satisfy the requirements of a wide-bodied display.

In order to minimize cost and simplify structure, multiple backlight units drive the plurality of lamps in parallel. A conventional parallel driving circuit utilizes a balance coil for balancing currents in each lamp.

FIG. 1 is a schematic representation illustrating an inverter for driving a multiple backlight disposed with a balance coil, and FIG. 2 is a schematic representation illustrating a structure of a conventional balance coil.

Referring to FIGS. 1 and 2, an inverter includes a driving circuit 1, a transformer 2 for driving two fluorescent lamps LP1 and LP2, and a feedback control circuit 3.

Furthermore, the inverter includes balance coils 4 and 4', respectively, connected to a lamp for balancing current flowing through a first lamp LP1 and a second lamp LP2. Ballast capacitors C1 and C2 are used for preventing the current flowing through each lamp LP1 and LP2 from increasing, and are connected in series to each lamp LP1 and LP2.

Referring to FIG. 2, the balance coils 4 and 4' include a bobbin 11, a core 12 inserted into a groove 11*a* of the bobbin 11 and a coil 13 wrapped at an external side of the bobbin 11.

The current flowing through each lamp LP1 and LP2 is balanced between each lamp by the coils 4 and 4'. Thereby, the backlight unit is stably maintained without any luminance difference between the lamps.

However, in the conventional inverter, one balance coil 4 and '4' is connected to each lamp LP1 and LP2, thus requiring a large number of balance coils. Therefore, because of the large number of balance coils used the conventional inverter is uneconomical and is large in size.

Furthermore, the conventional inverter uses ballast capacitors C1 and C2 to prevent a current increase in each lamp, and if the ballast capacitors are used, a high voltage is applied to both ends of the transformer 2 to the detriment of the transformer. Consequently, the use of ballast capacitors reduces the stability of the transformer.

Meanwhile, the conventional balance coils 4 and 4' have a limitation in that by structurally increasing the size of the core 12 there is a high possibility of creating an inferior quality of goods due to core saturation.

Accordingly, there is a need for an improved inverter used for driving a backlight of a liquid crystal display (LCD) that is both small in size and economical.

SUMMARY OF THE INVENTION

Exemplary embodiments of the present invention address at least the above problems and/or disadvantages and provide at least the advantages described below. Accordingly, an aspect of the present invention is to provide a balance coil by which a single bobbin is wound with two coils, such that, for example, balance coils each connected to at least two lamps are disposed in an inverter for driving a backlight.

Another object is to provide a balance coil for which the size of a core can be increased to prevent a discrepancy due to core saturation.

Still another object is to provide an inverter for driving a backlight using a balance coil that is both economical and small in size.

Still a further object is to provide a safe inverter for driving a backlight that does not require the use of ballast capacitors that utilize high voltages. Instead, a leakage inductance that is created by a coil-winding structure of a balance coil may be used as a current increase prevention element of a lamp.

In order to achieve the above-described aspects of an exemplary embodiment of the present invention, there is provided a balance coil comprising a bobbin having a winding part divided into at least three parts; a core disposed in the bobbin; and first and second coils disposed on the divided winding parts.

The winding part comprises a first winding part, centrally disposed on the bobbin, on which the first coil is wound; and second and third winding parts disposed on either side of the first winding part, respectively, on which the second coil is wound.

In accordance with another exemplary embodiment of the present invention, the winding part comprises first and second winding parts, centrally disposed on the bobbin, on which the first coil is wound; and third and fourth winding parts, disposed at either side of the first and second winding parts, respectively, on which the second coil is wound.

The bobbin comprises a core insertion groove for mounting the core wherein the core insertion groove is formed lengthwise.

In accordance with another object of an exemplary embodiment of the present invention, an inverter for driving a backlight comprises a driving circuit for driving at least two of a plurality of lamps; a transformer for connecting the driving circuit to the plurality of lamps; and a balance coil connected to at least two of the plurality of lamps for balancing the current flowing through the at least two of the plurality of lamps.

The balance coil comprises a bobbin having a winding part divided into at least three parts; a core disposed in the bobbin; and first and second coils disposed on the divided winding parts.

According to the exemplary embodiments of the present invention, there is an advantage in that a balance coil is connected to at least every two lamps for the formation of an inverter, thereby minimizing the cost, number of balance coils used and the size of the inverter.

Furthermore, the bobbin is lengthened lengthwise to increase the size of the core axially inserted into the bobbin to thereby prevent core saturation.

Preferably, the inverter for driving the backlight according to an exemplary embodiment of the present invention further comprises a feedback control circuit for controlling the driving circuit in response to the current flowing through the at least two of the plurality of lamps.

Preferably, the inverter for driving the backlight according to an exemplary embodiment of the present invention further comprises a current increase prevention element connected in series with each of the plurality of lamps for preventing the current flowing through each lamp from increasing.

The current increase prevention element comprises leakage inductances generated by the balance coil.

By way of the current increase prevention element, the ballast capacitors feared to generate a high voltage may be dispensed thereby providing a more a stable inverter.

The backlight is a light source of a liquid crystal display apparatus.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWING FIGURES

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
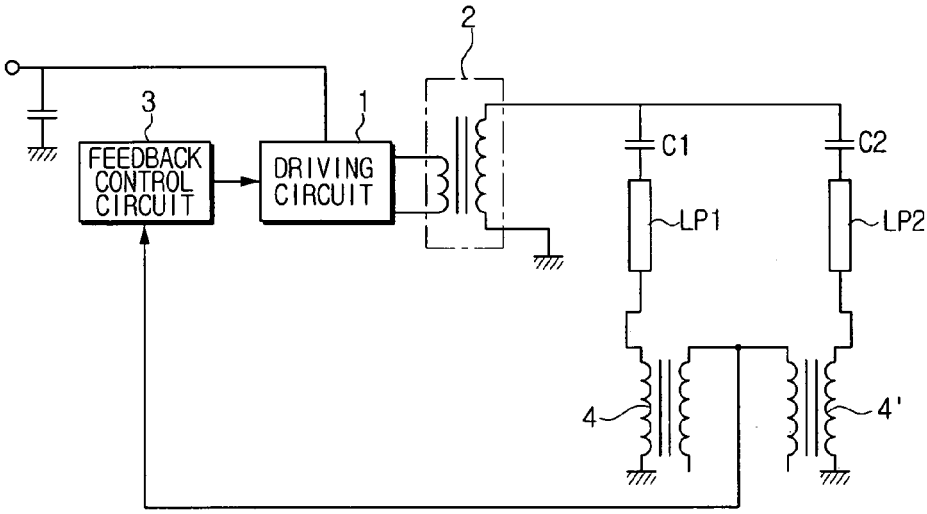
FIG. 1 (PRIOR ART)
FIG. 1 is an exemplary drawing of a conventional inverter for driving a backlight.
Figure 2:
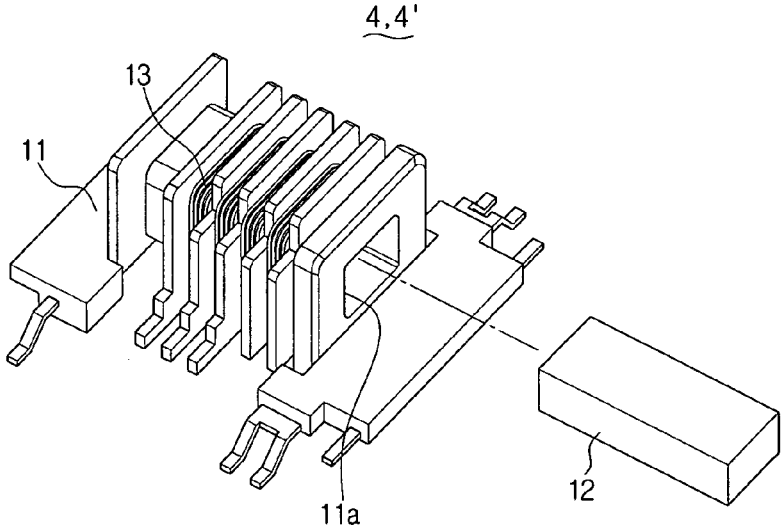
FIG. 2 (PRIOR ART)
FIG. 2 is a perspective view illustrating a structure of a conventional balance core.
Figure 3A:
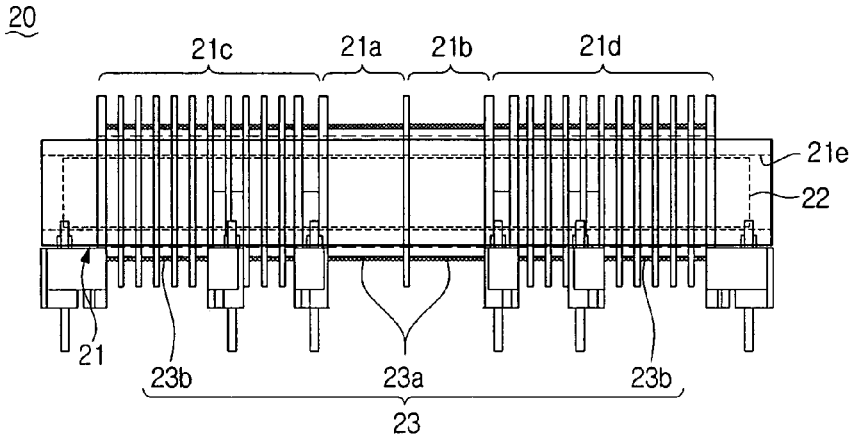
FIGS. 3A and 3B are front and plan views each illustrating a balance coil according to an exemplary embodiment of the present invention.
Figure 3B:
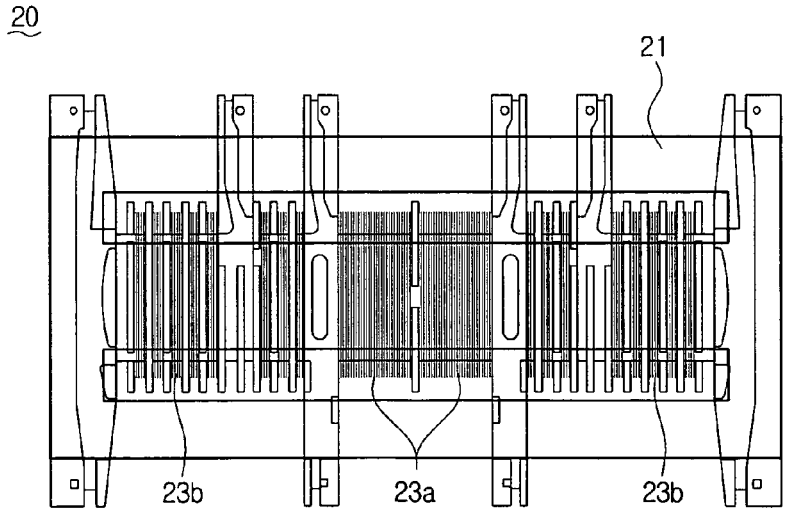

Referring to FIGS. 3A and 3B, a balance coil 20 includes a bobbin 21, a core 22 and a coil 23.

The bobbin 21 is mounted with four winding parts 21*a*, 21*b*, 21*c* and 21*d* according to a feature of an exemplary embodiment of the present invention. The bobbin 21 is formed therein with a core insertion groove 21*e*.

The core 22 is insertably formed in the core insertion groove 21*e* of the bobbin 21.

The coil 23 is wound on each winding part 21*a*, 21*b*, 21*c* and 21*d* of the bobbin 21. The first and second winding parts 21*a* and 21*b* are, for example, disposed with a first coil 23*a*, and the third and fourth winding parts 21*c* and 21*d* are, for example, mounted with second coils 23*b* each connected to two lamps as will be described later. Exemplary lamps include Cold Cathode Fluorescent Lamps (CCFL).

In other words, the balance coil according to an exemplary embodiment of the present invention is such that a bobbin 21 is provided with at least two winding parts. However, in an exemplary embodiment of the present invention four winding parts 21*a*, 21*b*, 21*c* and 21*d* are provided. By way of the four winding parts, the first coil 23*a* and the second coil 23*b* are wound. Consequently, coils that are supposed to be connected to two lamps are wound on a single bobbin in order to reduce the number of balance coils by half when the inverter is constructed.

As mentioned earlier, if the bobbin 21 is provided with four winding parts 21*a*, 21*b*, 21*c* and 21*d*, the bobbin is lengthened lengthwise to further increase the length of the core insertably mounted in the bobbin 21. There is a correlation between the length of the core and a margin at which core saturation begins. It is desirable to prevent core saturation as it results in the creation of inferior goods. Accordingly, a margin at which core saturation begins increases as core 22 length is increases. Thus, by using a longer core, core saturation is avoided.

Figure 4A:
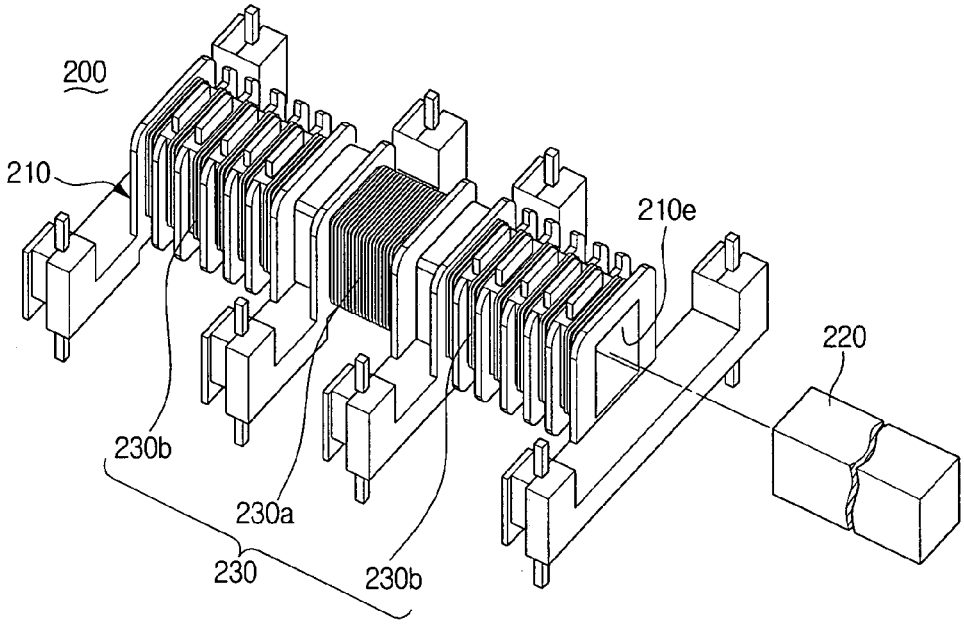
FIGS. 4A and 4B are perspective and plan views each illustrating a balance coil according to another exemplary embodiment of the present invention.
Figure 4B:
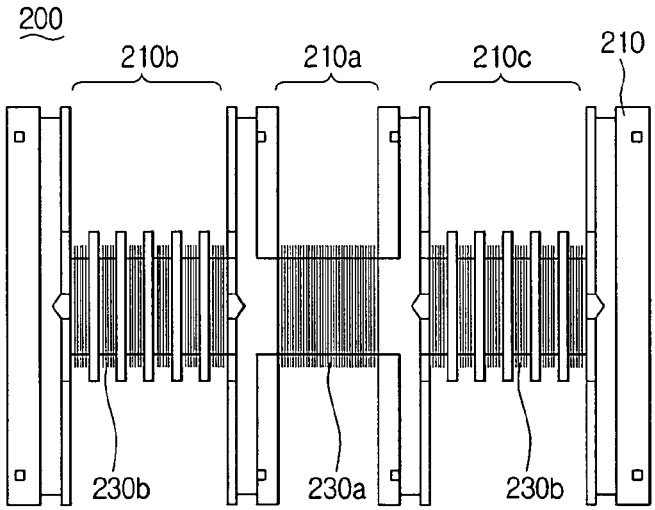

FIGS. 4A and 4B are perspective and plan views each illustrating a balance coil according to another exemplary embodiment of the present invention.

As evidenced from the drawings, a balance coil 200 according to the exemplary embodiment of the present invention is provided with three winding parts 210*a*, 210*b* and 210*c*, where the structure is the same as that of the first embodiment except that a first winding part 210*a* is wound by a first coil 230*a*, and second and third winding parts 210*b* and 210*c* are wound by second coil 230*b*, such that related reference numerals to those of FIGS. 3A and 3B are given and a detailed explanation thereof is omitted.

Even in this case, coil 230 comprises coils 230*a* and 230*b* that are wound on a single bobbin 210, and a single balance coil is connected to every two lamps so as to form an inverter. Furthermore, because the bobbin 210 is axially lengthened in order to lengthen the size of the core 220, core saturation can be avoided.

Figure 5:
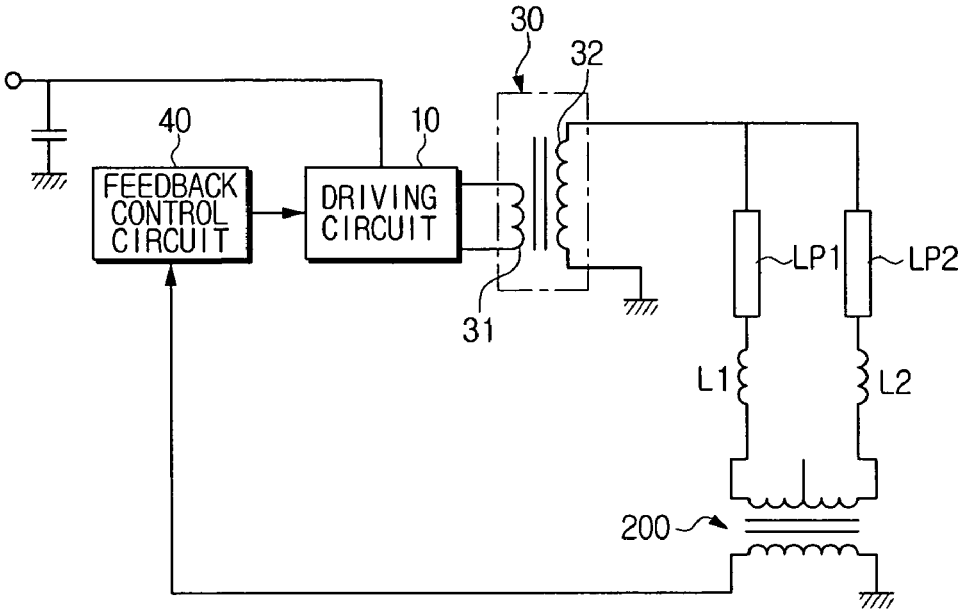
FIG. 5 is a schematic drawing illustrating an inverter for driving a backlight according to an exemplary embodiment of the present invention.

Meanwhile, FIG. 5 is a schematic drawing illustrating an inverter for driving a backlight has a balance coil 20 or 200 having the features described above. While the description below will refer to balance coil 200, balance coil 20 may alternatively be used. An exemplary backlight is a back light for an LCD.

Referring to FIG. 5, the inverter for driving a backlight according to an exemplary embodiment of the present invention includes, for example, a driving circuit 10 for converting a DC signal to an AC signal, a transformer 30 having a main coil 31 connected to the driving circuit 10 and an auxiliary coil 32 for outputting an AC signal, and a balance coil 20 or 200 connected to the two lamps for balancing the current flowing in the first lamp LP1 and the second lamp LP2.

The balance coil 200 is the same as what has been described above. The second coil 230*b* wound on the second and third winding parts 210*b* and 210*c* configured on the bobbin 210 of the balance coil 200 are respectively connected to the first lamp LP1 and the second lamp LP2. In other words, as mentioned earlier, a single balance coil 200 is connected to the lamps LP1 and LP2 in order to balance the current. Because of this reason, the number of needed balance coils can be reduced by half as compared to the conventional method where one balance coil is used for each lamp.

Furthermore, the inverter according to an exemplary embodiment of the present invention is equipped with a feedback control circuit 40 for controlling the driving circuit 10 in response to the amount of current flowing through the lamps. The feedback control circuit 40 may be, for example, a pulse width modulation controller.

Still further, the inverter according to an exemplary embodiment of the present invention, includes an element for preventing currents flowing through each lamp from increasing and is connected in series with each lamp.

For use as the current increase prevention element, leakage inductances L1 and L2, created from the second coil 230*b*, are used according to the coil winding structure of the balance coil 200. The leakage inductances L1 and L2 are created if the balance coil 200 is configured according to an exemplary embodiment of present invention, such that the leakage inductances replace the function of the conventional ballast capacitors.

Consequently, the conventional ballast capacitors need not be used and instead leakage inductances L1 and L2 are used to prevent current through each of the lamps from increasing and provides a more stable inverter configuration.

As mentioned above, the inverter for driving a backlight according to an exemplary embodiment of the present invention is such that a current flowing through each lamp can be balanced by use of the balance coil 200 when a predetermined voltage is supplied to each lamp LP1 and LP2 by the transformer 30.

Furthermore, a plurality of lamps can be stablely driven while the current flowing in each lamp is prevented from increasing by the leakage inductances L1 and L2.

Meanwhile, despite the above embodiments describing the inverter being connected to a single balance coil for two lamps, it is also possible that one balance coil can be connected to a plurality of lamps, for example, three, four or more lamps.

As apparent from the foregoing, the balance coil and inverter for driving a backlight according to the exemplary embodiments of the present invention are advantageous in that the number of balance coils can be reduced which provides for a low-cost inverter of small size.

An additional advantage is that that as the axial size of the bobbin is increased, the size of a core installed therein and core saturation creation margin are also increased, thus preventing problems caused by core saturation.

Yet another advantage is that ballast capacitors no longer need to be used and instead, leakage inductances of balance coil are used to prevent current flowing through the lamps from increasing, thus providing a stable inverter.

While the invention has been shown and described with reference to certain embodiments thereof, it will be understood by those skilled in the art that various changes in form and details may be made therein without departing from the spirit and scope of the invention as defined by the appended claims.

What is claimed is:

1. A balance coil comprising:

a bobbin having a winding frame divided into at least three parts;

a core disposed in the bobbin; and first and second coils disposed on the divided winding parts, the first coil configured to balance currents in a first load connected to the first coil, and the second coil configured to balance currents in a second load connected to the second coil.

2. The coil as defined in claim 1, wherein the winding frame comprises:

a first winding part, centrally disposed on the bobbin, on which the first coil is wound; and second and third winding parts disposed on either side of the first winding part, respectively, on which the second coil is wound.

3. The coil as defined in claim 1, wherein the winding frame comprises:

first and second winding parts, centrally disposed on the bobbin, on which the first coil is wound; and third and fourth winding parts, disposed at either side of the first and second winding parts, respectively, on which the second coil is wound.

4. The coil as defined in claim 2, wherein the bobbin comprises a core insertion groove for mounting the core wherein the core insertion groove is formed lengthwise.

5. An inverter for driving a backlight comprising:

a driving circuit for driving at least two of a plurality of lamps;

a transformer for connecting the driving circuit to the plurality of lamps; and a balance coil connected to at least two of the plurality of lamps for balancing the current flowing through the at least two of the plurality of lamps;

wherein the balance coil comprises:

a bobbin having a winding frame divided into at least three parts;

a core disposed in the bobbin; and first and second coils disposed on the divided winding parts, the first coil configured to balance currents in a first load connected to the first coil, and the second coil configured to balance currents in a second load connected to the second coil.

6. The inverter as defined in claim 5, wherein the winding surface comprises:

a first winding part centrally disposed on the bobbin, on which the first coil is wound; and second and third winding parts disposed on either side of the first winding part, respectively, on which the second coil is wound.

7. The inverter as defined in claim 5, wherein the winding frame comprises:

first and second winding parts, centrally disposed on the bobbin, on which the first coil is wound; and third and fourth winding parts, disposed at either side of the first and second winding parts, respectively, on which the second coil is wound.

8. The inverter as defined in claim 6, wherein the bobbin comprises a core insertion groove for mounting the core wherein the core insertion groove is formed lengthwise.

9. The inverter as defined in claim 5, further comprising a feedback control circuit for controlling the driving circuit in response to the current flowing through the at least two of the plurality of lamps.

10. The inverter as defined in claim 5, further comprising a current increase prevention element connected in series with each of the plurality of lamps for preventing the current flowing through each lamp from increasing.

11. The inverter as defined in claim 10, wherein the current increase prevention element comprises leakage inductances generated by the balance coil.

12. The inverter as defined in claim 5, wherein the backlight is a light source of a liquid crystal display apparatus.

13. The inverter as defined in claim 5, wherein the plurality of lamps are plurality of Cold Cathode Fluorescent Lamps.

14. The inverter as defined in claim 9, wherein the feedback control circuit comprises a pulse width modulation controller.

15. The inverter as defined in claim 5, wherein the driving circuit converts a DC signal to an AC signal.

* * * * *